United States Patent [19]

Schirneker

[11] 4,136,616

[45] Jan. 30, 1979

[54] CARTRIDGE FOR HAND AND SHOULDER FIREARMS

[76] Inventor: Hans-Ludwig Schirneker, Engelslit 10, D-4773 Mohnesee-Vollinghausen, Fed. Rep. of Germany

[21] Appl. No.: 712,665

[22] Filed: Aug. 9, 1976

[30] Foreign Application Priority Data

| | | | |
|---|---|---|---|
| Aug. 9, 1975 | [DE] | Fed. Rep. of Germany | 2535704 |
| Sep. 18, 1975 | [DE] | Fed. Rep. of Germany | 2541632 |
| Dec. 17, 1975 | [DE] | Fed. Rep. of Germany | 2556744 |
| Jun. 11, 1976 | [DE] | Fed. Rep. of Germany | 2626219 |

[51] Int. Cl.[2] ..... F42B 11/10; F42B 5/02

[52] U.S. Cl. ..... 102/38 R; 102/91

[58] Field of Search ..... 102/38, 91, 92.1–92.7

[56] References Cited

U.S. PATENT DOCUMENTS

| | | | |
|---|---|---|---|
| 914,992 | 3/1909 | Taylor | 102/91 |
| 1,512,026 | 10/1924 | Holden et al. | 102/91 |
| 1,556,160 | 10/1925 | Riggs | 102/91 |
| 2,321,344 | 6/1943 | Whipple | 102/91 |
| 2,482,132 | 9/1949 | Studler et al. | 102/92.3 |
| 3,747,533 | 7/1973 | Rossmann | 102/92.7 |
| 3,881,421 | 5/1975 | Buezynski | 102/91 X |
| 3,948,180 | 4/1976 | Silvia et al. | 102/52 |

FOREIGN PATENT DOCUMENTS

| | | | |
|---|---|---|---|
| 690460 | 4/1953 | United Kingdom | 102/38 |

*Primary Examiner*—Harold J. Tudor
*Attorney, Agent, or Firm*—DonaldD. Jeffery

[57] ABSTRACT

A cartridge for firearms comprises a cartridge case filled with powder and containing a fuse and a projectile being in the form of a cylindrical main body having at its front end a central projecting tip and/or a projecting circumferential rim and having a circumferential shoulder of a relatively hard material such as iron, tombac, or copper.

14 Claims, 33 Drawing Figures

FIG. 1
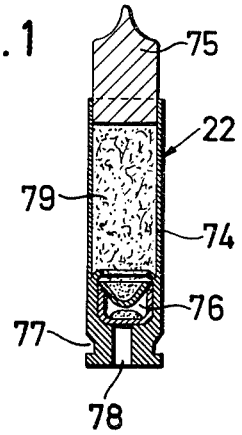
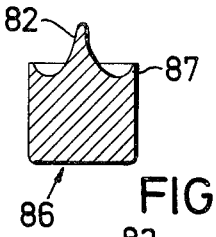
FIG. 2
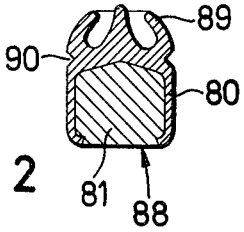
FIG. 4
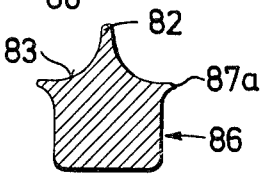
FIG. 3
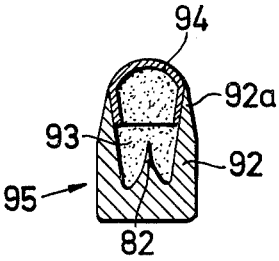
FIG. 5
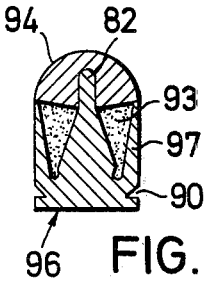
FIG. 7
FIG. 8
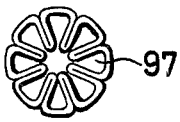
FIG. 6
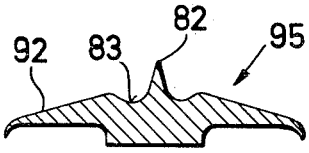
FIG. 9
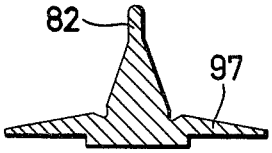

FIG. 10
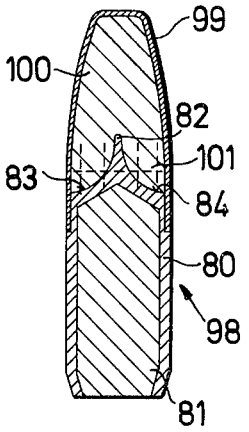
FIG. 11
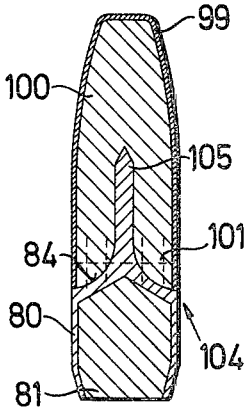
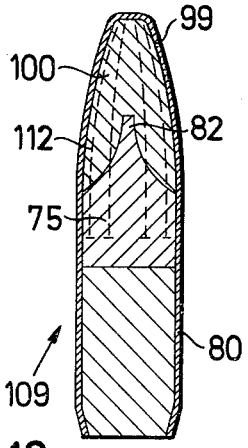
FIG. 12
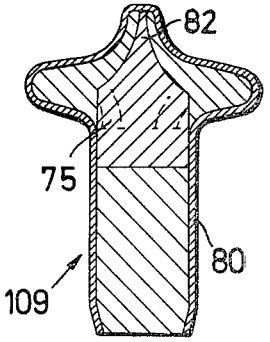
FIG. 13

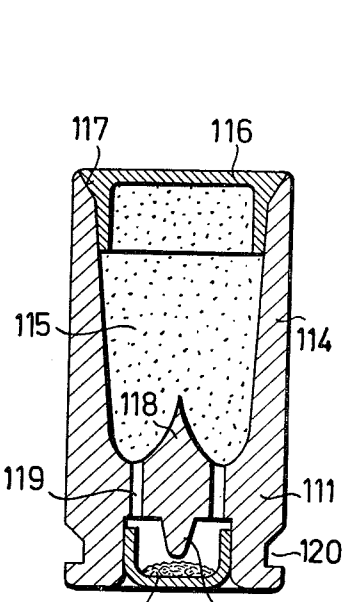
FIG. 18
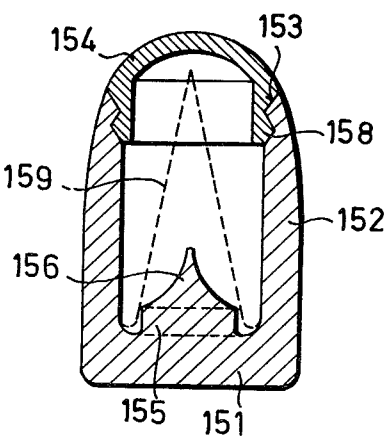
FIG. 16
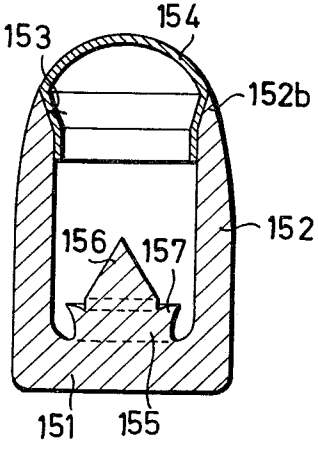
FIG. 14
FIG. 17
FIG. 15

CARTRIDGE FOR HAND AND SHOULDER FIREARMS

This invention relates to a cartridge comprising a cartridge case filled with powder and containing a fuse and a projectile inserted therein, suitable for use as ammunition for hand firearms and shoulder arms.

The invention is intended more particularly but not exclusively for hand firearms and for hunting guns.

Hand firearms used by the police are required to stop a possible attacker instantly without inflicting serious injuries on him or endangering his life. It would therefore be desirable for police firearms to be equipped with ammunition which produces severe pain over a wide area around the point of entry without penetrating deeply into the body and therefore without the capability of injuring any vital organs of the attacker. In other words, it would be desirable for police purposes to have ammunition available which would put an attacker out of action by a single hit without seriously injuring him. At the same time, the ammunition should be able to penetrate comparative thin-walled objects such as motor car bodies or tires, for example.

For hunting purposes, on the other hand, it is desirable to have ammunition which produces a shock effect preferably causing instant death even when no vital organs have been hit. To achieve this purpose, it is important that the projectile hitting the game should damage as many nerve fibres as possible or at least affect them in such a way that pain impulses are transmitted to the brain from a large number of nerve fibres simultaneously so that the shock effect is produced.

The ammunition conventionally used in hand firearms and hunting guns do not fully satisfy these requirements. The effect of conventional ammunition used in hand firearms when fired against a person is virtually restricted to the channel forged by the ammunition inside the body so that a shot fired through parts of the body which are not vital will have little or no stopping effect on the person. But even shots fired through vital organs frequently have no instant stopping effect but leave the person sufficient time to shoot back or run away. On the other hand, the projectiles burst when they strike a hard object so that hand firearms equipped with conventional ammunition in many cases cannot be used to shoot through the body of a car to immobilise the persons inside it.

In ammunition used for hunting, it is known to use projectiles having a front part which bursts inside the body of the game and breaks up into a large number of small parts so that the flesh surrounding the channel forged by the projectile is permeated by metal pieces. Moreover, the projectile or remnants thereof are liable to be left inside the body.

SUMMARY OF THE INVENTION

It is an object of the present invention to provide ammunition for shoulder arms and hand firearms which, when used as ammunition for hand firearms, provides a more certain stopping effect than has hitherto been possible, combined with greater power to penetrate sheet metal and motor car tires, and when used for hunting purposes produces a much better shock effect.

According to the invention, there is provided a cartridge for firearms comprising a cartridge case filled with powder and containing a fuse and a projectile inserted in the case, the projectile being in the form of a cylindrical tip and/or a projecting circumferential rim and having a circumferential shoulder of a relatively hard material such as iron, tombac or copper.

When a projectile according to the invention, which is provided with a projecting rim, strikes against a soft material such as a human body, for example, the rim is bent outwards, i.e. the front end of the projectile is spread out so that its diameter is increased. The projectile therefore enters the body over a relatively large surface area and its kinetic energy is rapidly destroyed. This means that the projectile has a widespread but shallow action and therefore cannot reach or damage vital organs. If the projectile has a point at the front continuous with the circumferential rim or shoulder, for example by way of a concave curve, then the spreading effect is enhanced because the point and the adjacent part connecting it to said rim or shoulder pushes the material lying in front of it to the side, thereby increasing the spreading effect. If, on the other hand, such a projectile strikes a harder object, for example a sheet metal wall, then the metal is dented and pushes the projecting rim inwards so that it is so to speak rolled up and enables the projectile to pass through the metal.

If the projectile according to the invention is filled at the front end with a powerful pain producing substance such as a disinfectant, for example, the stopping effect is greatly increased by the powerful pain instantly produced without the wound itself being increased in size or any other deleterious effects such as toxic effects, for example, being produced.

The projectiles preferably used for hunting purposes, which have a front part at least partly made of softer material, are also spread out on hitting the body of the game, in this case by the action of the point and the concave connecting curve connecting the point to the circumferential shoulder. These parts push the softer material of the front part almost radially outwards so that the softer material has a depth effect spread over a relatively wide radius. This produces the powerful shock effect required for hunting purposes. The softer material in the front part of the projectile may either by broken up into small pieces and forced into the body of the game or held together by a deformable jacket. Since the projectile is not subjected to compression and its tip therefore not inverted, a clean exit out of the body is ensured in spite of the greater radial depth effect due either to direct influence or to pressure waves.

The ammunition according to the invention ensures a rapid stopping action or powerful shock effect even with small calibre guns. For use against persons, it is possible to choose a form of projectile which cannot cause any permanent damage or mortal injury while for hunting purposes it is possible to choose a form of projectile which will cause the death of an animal even when no vital organs are hit.

BRIEF DESCRIPTION OF THE DRAWINGS

Other features and advantages of the invention will appear from the following description of the drawings which show examples of ammunition according to the invention.

FIG. 1 is a longitudinal section through a cartridge according to the invention, FIG. 2 is a longitudinal section through another embodiment of the projectile according to the invention, FIG. 3 is a longitudinal section through the projectile of FIG. 2 but after it has hit the target, FIG. 4 is a longitudinal section through another embodiment of the projectile according to the invention, FIG. 5 is a longitudinal section through yet another embodiment of the projectile according to the invention, FIG. 6 is a longitudinal section through the projectile of FIG. 5 after it has a relatively soft body, FIG. 7 is a longitudinal section through another embodiment of the projectile according to the invention, FIG. 8 is an end-on view of the front end of the projectile according to FIG. 7, FIG. 9 is a longitudinal section through the projectile of FIG. 8 after it has hit a relatively soft object, FIGS. 10 to 13 are longitudinal sections through various embodiments of projectiles according to the invention suitable for hunting purposes, FIG. 14 is a longitudinal section through another embodiment of a hollow projectile having a point accommodated therein, FIG. 15 is a longitudinal section through the projectile of FIG. 14 after it has hit a soft elastic body, FIG. 16 is a longitudinal section through yet another embodiment of a projectile having a point inside a cavity, FIG. 17 is a longitudinal section through the projectile of FIG. 16 after it has hit a soft elastic body, FIG. 18 is a longitudinal section through an embodiment of a hollow projectile forming a case for an ammunition which has no separate cartridge case.

DESCRIPTION OF THE PREFERRED EMBODIMENTS

Figure 25:
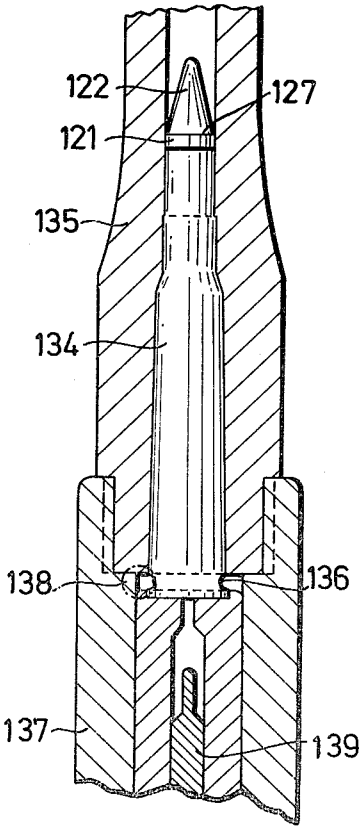
FIG. 25 is a longitudinal section through a weapon indicated only schematically, having a cartridge with a projectile according to FIGS. 19 to 21 or 22 to 24 in the barrel thereof.

The cartridge 22 shown in FIG. 1 comprises a cartridge case 74 and a projectile 75. The cartridge case 74 has a fuse 76 sunk into the bottom of the case and therefore situated at some distance from the extraction groove 77 so that its diameter is not limited by the depth of the groove 77. Indeed, the diameter of the fuse 76 is limited only by the diameter of the cartridge case 74 which in the example illustrated has substantially the same diameter throughout its length except that it might be slightly tapered to facilitate its removal from the barrel of a gun.

A channel 78 leads from the back end of the cartridge case 74 to the fuse 76 to provide access for the firing pin. This design is particularly suitable for small calibre guns in which the cartridge case cannot be given a stepped form.

The cartridge case 74 is filled with powder 79 in the usual manner.

In the embodiment illustrated in FIGS. 2 and 3, the projectile 86 is made of a single material. This projectile has a shoulder extending right round it formed by a rim 87 which is initially upright and which, when it encounters a relatively soft body, is pushed radially outwards to form a circumferential collar 87*a* which enhances the radial depth effect of the projectile so that the energy of impact of the projectile is rapidly used up and a relatively large but shallow wound is produced.

In the embodiment of FIG. 4, the projectile 88 has an inwardly curved rim 89 which is connected to a jacket 80 by a groove 90. On hitting a target, the rim 89 is in this case also spread outwards substantially in the radial direction.

The projectile 95 of FIGS. 5 and 6 differs from the projectile of FIGS. 2 and 3 mainly in that its point 82 is situated deeper down and the rim 92 correspondingly extends above it so that when the projectile hits a relatively soft body the rim is spread much further outwards, as can be seen from FIG. 6. The volume of the space 93 is substantially the same as that in the other types of projectile described. The point 82 may even be completely omitted.

The cap 94 may also be formed by an ampoule inserted in the projectile and filled with pain inducing substance.

In the embodiment shown in FIGS. 7 to 9, the projectile 96 has an upright rim formed by a plurality of segments 97. These segments 97 are folded radially outwards into the position shown in FIG. 9 when the projectile 96 encounters a soft body, whereas before firing the semgents 97 are placed close together as shown in FIG. 8. FIG. 8 also shows that the segments 97 are made in one piece with the main body of the projectile 96. The circumferential groove 90 at the same time serves as a stop which limits the outward movement of the segments 97 into the position shown in FIG. 9.

While the projectiles shown in FIGS. 1 to 9 are mainly suitable for hand firearms and also rifles, FIGS. 10 to 13 show projectiles suitable for shooting game.

The projectile 98 of FIG. 10 comprises a jacket 80 and core 81. The jacket 80 has a point 82 connected to a shoulder 84 through a concave transitional surface 83. The projectile also has an attachment comprising a jacket 99 of comparatively hard material and a filling 100 of softer material such as lead. The jacket 99 has pre-set breaking points 101 in the form of perforations or other weak points in the material in the region of the point 82 so that when the projectile together with its attachment hits a target, the attachment is torn off in this region and spread outwards by the rear of the body of the projectile and broken up into relatively large pieces. The shoulder 84 pushes these pieces virtually radially outwards into the region surrounding the path of the projectile in the animals body, thereby ensuring that the shot has a powerful depth effect.

The projectile shown in FIG. 11 has a longer and thicker point 105 than that shown in FIG. 10. This point 105 provides sufficient support for the attachment so that the jacket 99 need only rest on the shoulder 84 of the jacket 80 and not overlap the jacket 80.

The main difference between the projectiles shown in FIGS. 12 and 13 and the projectiles of FIGS. 10 and 11 is that in the projectile of FIGS. 12 and 13, the jacket 99 of the attachment is an integral part of the jacket 80 of the projectile and the whole jacket contains a hard projectile body 75. The combined jacket 80, 99 has longitudinally extending perforations 112 in its front portion to enable the filling 100 to spread outwards after a target has been hit without the jacket 99 at the same time being torn off the jacket 80. This means that the projectile 109, which is shown before firing in FIG. 12 and after hitting a target in FIG. 13, does not break up into separate pieces when the front portion is forced outwards and yet produces just as great a shock effect in the animal which has been hit owing to the increase in the area of tissue damage where the projectile enters the body and the resulting propagation of pressure waves in the area of entry. The same sudden massive nerve stimulation is therefore produced, which generally leads to instant death but in any case to a sufficiently large wound.

FIGS. 14 to 24 show details of the projectiles on an enlarged and in some cases greatly enlarged scale.

The projectile of FIGS. 14 and 15 has a projectile body 151 in the form of a disc which extends into a sleeve portion 152 the wall of which decreases in thickness towards the front end. The projectile itself therefore also tapers towards the front end with a slight curvature so that it is guided in the barrel of the gun over only about half to one third of its length. At its front end, the sleeve portion 152 has an inwardly facing conical wedge surface 153 designed to support a ballistic cap 154 which rests on it with a corresponding counter surface. This cap 154 closes the front end of the projectile and ensures that when it hits a soft elastic body, the wall of the sleeve portion 152 is pushed outwards until it assumes the form of an annular disc **152*a* seated on the main body 151 of the projectile, as can be seen from FIG. 15. In that position, what was originally the front edge 152*b* is curved back as shown in FIG. 15**.

From the centre of the body 151 of the projectile, inside the sleeve portion 152, extends a substantially cylindrical base 155 which continues into a point 156. The base 155 widens outwards into a rim 157 which serves to catch the remains of the ballistic cap 154 which is pushed into the projectile on impact with a soft elastic body and is impaled on the point 156.

The example according to FIGS. 16 and 17 differs from that of FIGS. 14 and 15 mainly in that its point 156 is seated on a purely cylindrical base 155 and in that the ballistic cap 154 is pushed into the sleeve portion 152 by a snap lock engagement provided by a groove 158 encircling the interior wall of the sleeve portion 152. In both cases the point 156 may be conical as shown in FIGS. 14 and 15 or it may have a concave side wall as shown in FIGS. 16 and 17. In this case, the remains of the ballistic cap 154 again collect in the area round the base 155 when the projectile has assumed the form shown in FIG. 17.

In FIG. 16 it is indicated that the point 159 may also be substantially longer and may extend practically into the inside of the ballistic cap 154, thereby increasing the total weight of the projectile.

In the embodiment shown in FIG. 18, the projectile is cylindrical over its whole length and comprises a main body 111 with built-in fuse 112 and detonator anvil 113 and a sleeve portion 114 filled with powder 115 and closed by a flat cap 116 which is inserted into the sleeve portion 114 where it rests on an internal chamfered wedge surface 117 thereof. A point 118 projects into the filling of powder 115. When such a cartridge case is fired, the igniting flame reaches the powder through the flash holes 119. As the powder 115 burns down, the cap 116 is burned or otherwise dissolved so that the propellent gases which are developed expel from the barrel of the gun another, similar cylindrical projectile situated in front of the projectile just described.

The main body 111 of the projectile also has a retraction groove 120 for unloading and for holding the projectile during firing. A sleeve projectile of this kind is not thrown out after firing but is pushed further along the barrel by the next projectile and is then itself fired off.

In all these embodiments, the wall of the sleeve portion is continuous with the base of the point without any sharp edged transition, i.e. it curves into the point so that the annular disc **152*a* subsequently formed by spreading out of the sleeve remains firmly united with the main body 151 or 111**.

Figure 20:
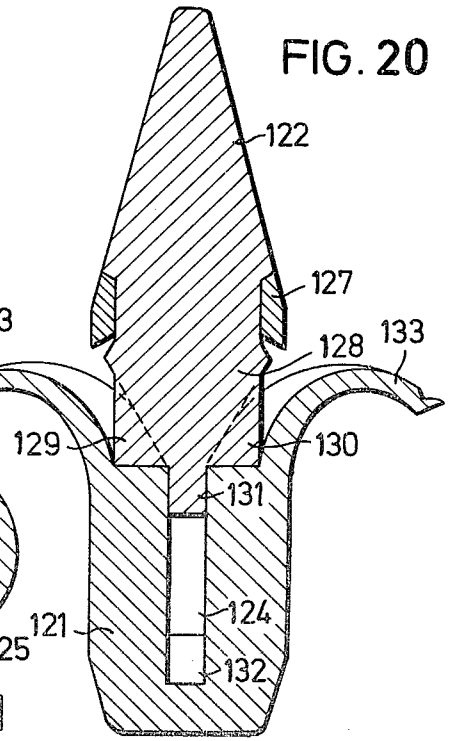
FIG. 20 is a longitudinal section through the projectile of FIG. 19 after it has hit an animal.
Figure 21:
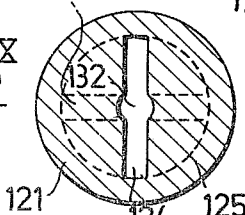
FIG. 21 is a cross-section taken on the line IX—IX through the projectile of FIG. 19.
Figure 19:
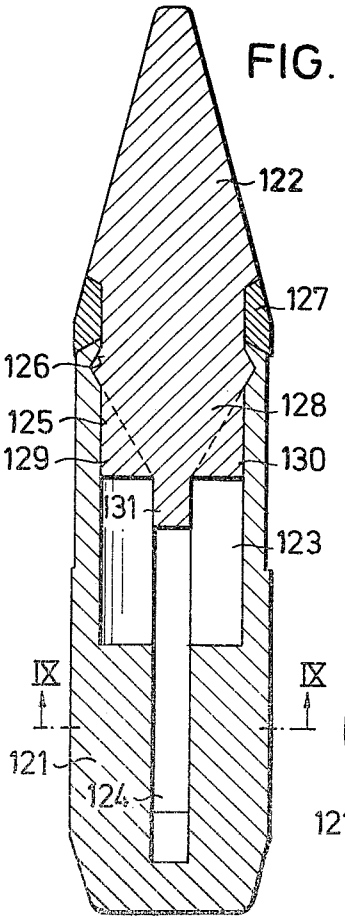
FIG. 19 is a longitudinal section through another embodiment of a projectile according to the invention suitable for use as ammunition for hunting.

The projectile of the cartridge shown in FIGS. 19 and 21 is composed of two parts, a projectile body 121 and a point 122 set into the body and rotatable in relation to it. When the projectile hits the target, the point 122 is pushed into the body 121 and deforms it as shown in FIG. 20.

The main body 121 is a solid body but contains two slits 123 and 124 intersecting at right angles. The slit 124 is deeper than the slit 123. The projectile body 121 has a cylindrical recess 125 at its front end, and a circumferential wedge shaped groove 126 above the recess.

The point 122 may be hollow but it may be solid as shown in FIGS. 19 and 20. In the region of its largest diameter, it carries a band 127 of soft material which is capable of entering the rifling of a gun. The rear end 128 of the point 122 is conical and has two tabs 129 and 130 situated diametrically opposite each other. These tabs are designed for insertion of the conical end 128 of the point 122 into the cylindrical recess 125, the lower edges of the tabs then resting on the bottom of the cylindrical recess 125 while an extension 131 from the rear end 128 fits into the hollow centre 135 formed by the two slits 123 and 124.

The point 122 can be rotated in relation to the body 121 of the projectile so that the tabs 129 and 130 can be aligned with one or the other of the two slots 123 and 124 or with neither of these slots. The depth to which the point 122 enters the body 121 of the projectile on hitting a target varies according to the angle of rotation of the point 122 in relation to the body 121, and the extent to which the point 122 then spreads the wall outwards varies accordingly. In FIG. 20, the tabs 129 and 130 have entered the shallower slit 123 so that the wall of the projectile body has been spread out in strips 133 of medium length. These strips would be longer if the point 122 had been rotated in relation to the projectile body 121 to a position where the tabs 129 and 130 are not in alignment with either of the slits, since in that case the point 122 is unable to penetrate the projectile body at all.

As an alternative, the projectile body 121 could be provided with only one slit or with more than two, the possibilities of varying the effect of impact of the projectile being thereby reduced or increased.

Figure 22:
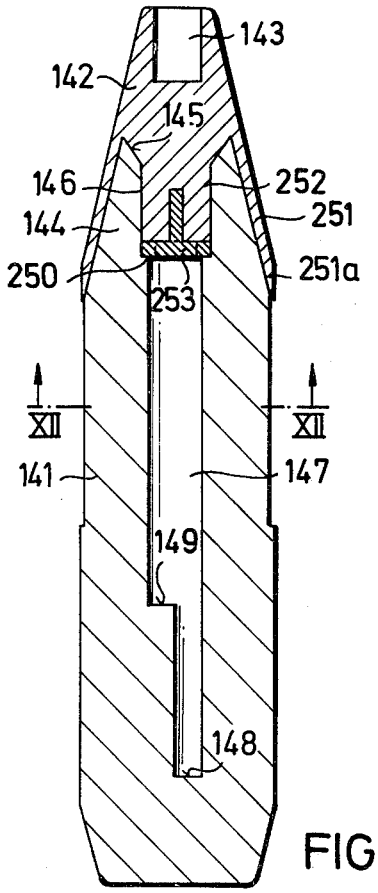
FIG. 22 is a longitudinal section through another embodiment of a projectile according to the invention suitable as ammunition for hunting.
Figure 23:
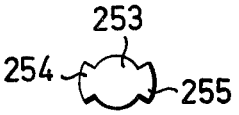
FIG. 23 is a partial view of the rear end of the point of the projectile shown in FIG. 22.
Figure 24:
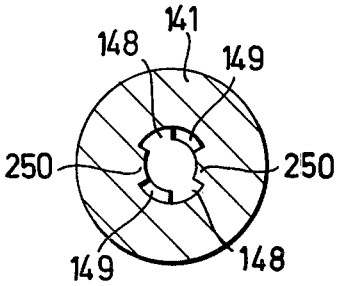
FIG. 24 is a cross-section taken on the line XII—XII through the projectile of FIG. 22.

FIGS. 22 to 24 show a variation of the two-part projectile of FIGS. 19 to 21 suitable for shooting game. This projectile has a projectile body 141 made of a metal such as copper, tombac or the like on which is mounted a tip 142 made of plastics, which has a recess 143 at its front end. The front end 144 of the projectile body 141 is tapered conically and it has an internal surface 145 tapering conically downwards towards the centre, which surface is continuous with a cylindrical recess 146. Below this recess 146 there is a blind bore 147 which extends over the major part of the length of the body 141 of the projectile. This blind bore 147 has two steps 148 and 149 at different depths and at its top end it has two steps 250 situated opposite each other.

The tip 142 extends downwards to form a conical covering 251 which covers the conical end 144 of the projectile body 141 and is continued down until it reaches the largest external diameter of the projectile and projects slightly over it at this point so that when the projectile is pushed into the barrel of a gun, the lower end 251*a* of the covering 251 is pushed into the rifling of the barrel. The tip 142 also has a cylindrical attachment 252 which fits into the cylindrical recess 146 of the projectile body 141. At the lower end of the attachment 252 is a disc 253 which has the outline shown in FIG. 23. This disc 253 is made of a harder material than the tip 142 and preferably metal. It has two projecting pieces 254 and 255 which cooperate with the steps 148, 149 or 250 of the blind bore 147, depending on the position to which the tip 142 is rotated in relation to the projectile body 141. This means that the tip 142 is also, like the point 122 in the example shown in FIGS. 19 to 21, rotatable about its longitudinal axis in relation to the projectile body 141.

When a projectile of FIGS. 22 to 24 hits a target and the projecting parts 254 and 255 of the disc 253 lie on the steps 250, the projectile penetrates the target in the usual manner. If, on the other hand, the tip 142 has been rotated in relation to the projectile body 141 so that the parts 254 and 255 of the disc 253 are in alignment with the steps 149 when the projectile hits the target, then the tip 142 is pushed into the body 141 of the projectile until the parts 254 and 255 lie on the steps 149. In this case, the conically tapering front end 144 cuts the sheath 251 off the tip 142 so that the tip 142 enters the body 141 of the projectile and folds it apart while the sheath 251 slips back, for example over the body of the projectile. The attachment 252 is adapted in plan view to the disc 253 with its projecting parts 254 and 255 so that the attachment can enter the blind bore 147 together with the disc.

If the projecting parts 254 and 255 of the disc 253 are in alignment with the steps 148 of the bore 147, the tip 142 can penetrate that much more deeply into the projectile body 141 on hitting a target.

FIG. 25 illustrates how a cartridge 134 having a projectile according to FIGS. 19 to 21 or 22 to 24 and seated in the barrel 135 of a gun (not shown in detail) can be rotated so that when the projectile strikes an object, the tabs 129 and 130 of the point 122 can be arranged to enter either one or other of the slits in the projectile body or neither of these slits, as desired. The soft elastic band 127 is pushed into the rifling (not shown) of the barrel 135 and thus prevents accidental rotation of the point 122. The projectile body 121, on the other hand, can be rotated about its longitudinal axis together with the rest of the cartridge 134. This can be achieved by providing the retraction grooves 136 of the cartridge with teeth or some other surface roughening (not shown). A toothed rack 138 or other adjustment element on the lock 137 of the gun may be pushed into the retraction groove 136 from the side to impart a partial rotation on the cartridge 134 in relation to the point 122 so that the effect obtained when the projectile hits the target can be adjusted before firing.

Not until the point 122 has been set to the required position in relation to the projectile body 121 is the percussion pin 139 released and the cartridge fired.

Figure 27:
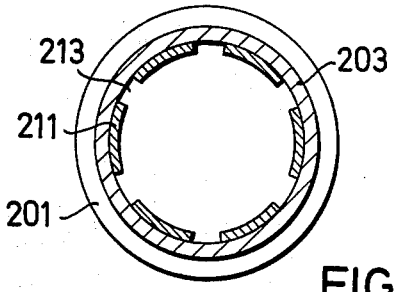
FIG. 27 is a cross-section taken on the line II—II through the projectile of FIG. 26.
Figure 26:
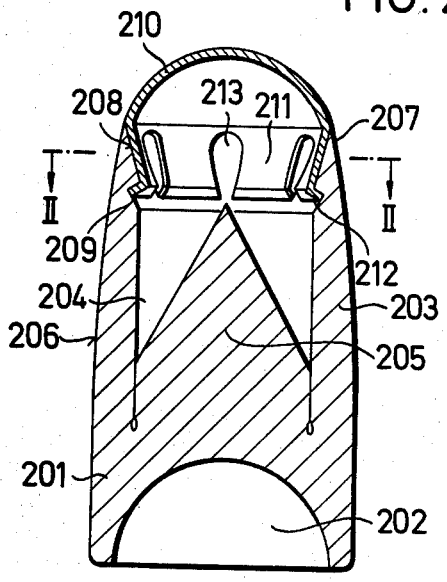
FIG. 26 is a longitudinal section through an embodiment of a projectile closed by a cap.

The projectile of FIGS. 26 and 27 has a cylindrical body 201 with hemispherical recess 202 in the bottom and forwardly extending cylindrical wall 203 enclosing a cavity 204 which in the example illustrated contains a point 205 which is an integral part of the projectile body 201. Although the wall 203 is substantially cylindrical, the external surface 206 of the projectile is slightly curved to impart a suitable ballistic form to the projectile.

The cylindrical wall 203 tapers to a sharp edge 207 from which a supporting surface 208 extends inwards at an angle at about 15°. This conical supporting surface 208 is continuous with a circumferential groove 209 situated approximately at the height of the outermost tip of the point 205.

The front end of the projectile is closed by a cap 210 inserted in press stud fashion. This cap 210 has tongue-like sections 211 which bear resiliently against the conical wall 208. These sections 211 end at the bottom in outwardly directed flanges 212 which hook into the groove 209. The sections 211 are separated from each other over practically the whole height of the supporting surface 208 by incisions 213.

Figure 28:
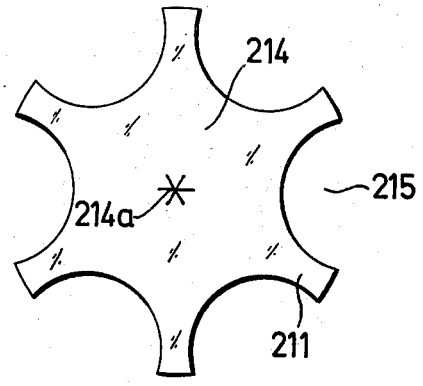
FIG. 28 is a plan view of a sheet metal cutout used as blank for producing the cap of the projectile according to FIGS. 26 and 27 but drawn to a smaller scale than these Figures.

FIG. 28 shows a cut-out blank 214 made, for example, of copper sheeting, from which the cap 210 is formed. This blank 214 has semi-circular cut-out portions 215 at its edge leaving sections 211 which are to form the sections 211 of the finished cap which will bear resiliently against the supporting surface 208 and which may be provided with flanges 212 for engagement in the groove 209. The cut-out portions 215 assume the form of the gaps 213 shown in FIG. 26 when the blank 214 has been curved over to form the cap shown in FIG. 26.

Figure 30:
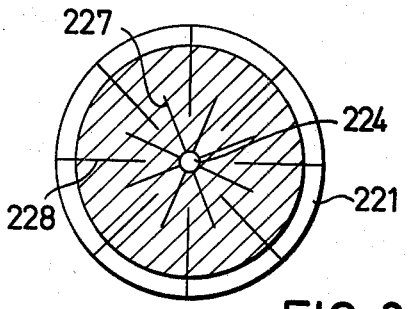
FIG. 30 is a cross-section taken on the line V—V through the projectile of FIG. 29 and FIGS. 31 to 33 show on a much enlarged scale three other examples of projectiles designed to be inserted in a cartridge case.
Figure 29:
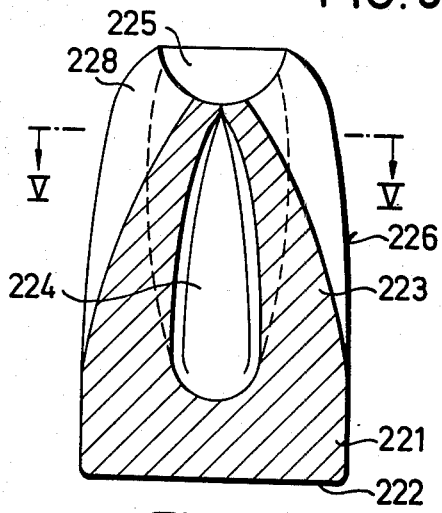
FIG. 29 is a longitudinal section through another embodiment of a projectile having a fluted cylinder wall which is compressed at its front end so that the projectile has a closed front end without a cap.

The projectile of FIGS. 29 and 30 is also closed at its front end but not by means of a cap. It again comprises a cylindrical body 221 which in this case has a flat bottom 222 but may also have a hemispherical recess. A fluted cylindrical wall 223 extends from the body 221 to the front end of the projectile where it is curved inwards so that it encloses a cavity 224 which is closed at the top. In the example illustrated, the projectile has a hemispherical recess 225 at its front end. This improves the spreading movement of the projectile when it hits a soft target.

The cylinder wall 223 is made in one piece with the main body 221 and is fluted and pressed together so that slits 227 extending outwards from the cavity 224 alternate with slits 228 extending inwards from the external surface 226.

When the cylinder wall 223 is spread outwards, it is unfolded but remains connected with the main body 221. The spreading effect can be adjusted by the length and depth of the slits.

This second embodiment therefore requires no cap to close the front end although if desired a cap may also be provided in conjunction with a fluted cylinder wall to finish off the body of the projectile.

In both embodiments, elements designed to assist the spreading movement of the projectile may be provided in the central cavity of the projectile body, for example, the tip 205, although, as can be seen from FIG. 29, this is not essential.

To facilitate impalement of the cap 210 on the point 205, preset fracture points in the form of slits 214*a*, for example, may be provided at the centre of the blank 214, but these weak points should not extend right through to the external surface of the cap 210. When the cap 210 encounters a soft target, it is then particularly easily impaled on the point and can slip far down to the base of the point so that it does not interefere with the function of the point. The cap may, if desired, be made of a softer material than the point.

Figure 31:
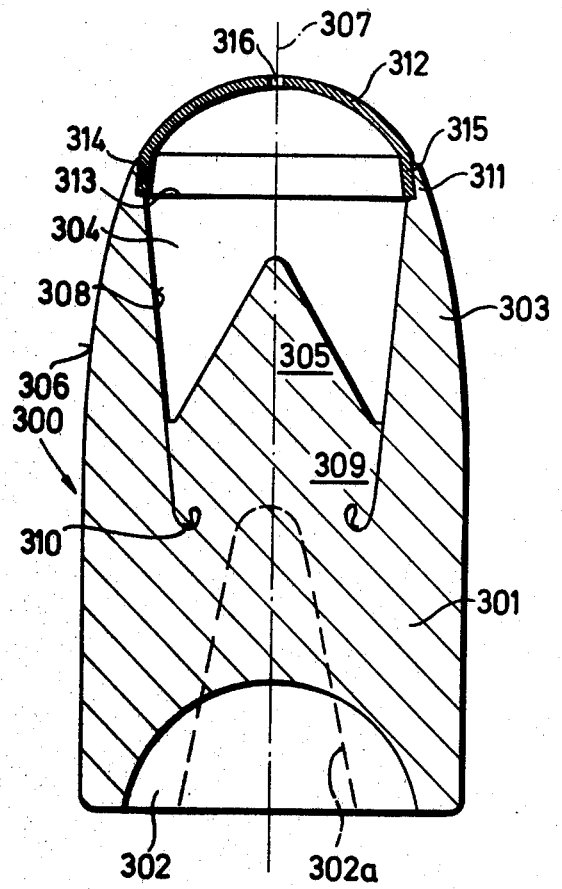

According to FIG. 31, the projectile 300 has a solid cylindrical body 301 with a hemispherical recess 302 in the bottom or rear end and a forwardly extending cylinder wall 303 enclosing a cavity 304. If desired, a narrower and deeper conical recess 302*a* may be provided so as to reduce the pressure with which the projectile is pushed into the rifling of the gun and the frictional resistance in the barrel.

On the inside of the cylinder wall 303 is a point 305 which projects into the cavity 304 and which, like the wall 303, forms an integral part of the body 301. The external surface 306 of the projectile curves slightly inwards towards the front end in order to impart a suitable ballistic form to the projectile. The surface is cylindrical, particularly in the region of the solid main body 301 of the projectile, and coaxial with the longitudinal axis 307 of the projectile.

The wall 303, which may also be regarded as the forwardly projecting rim, has an internal surface 308 which has substantially the form of a truncated cone tapering towards the projectile body 301. In the interior region of the projectile, the base 309 of the point 305 bears against the conical or truncated cone shaped internal surface 308, and the resulting plane of separation 310 between the two surfaces ends in the form of an inwardly curved hook which makes the wall 303 particularly strong at the point where it merges with the main body 301 of the projectile.

The forwardly projecting cylinder wall 303 enclosing the cavity 304 ends in a sharp edge 311 which encloses a shoulder serving as mounting for cap 312 which forms a ballistic hood. This shoulder is formed by a supporting surface 313 lying in a plane perpendicular to the longitudinal axis 307 and an upright side wall 314 perpendicular to the surface 313. The supporting surface 313 and side wall 314 enclose an angle smaller than 90°. This shoulder embraces a conical portion 315 of the cap 312 which is made of a thin walled material such as sheet metal.

At the centre of the cap 312 is a small aperture 316 to provide for equalisation of pressure if necessary between the cavity 304 and external atmosphere during manufacture of the projectile.

The projectile body 301 with parts formed on them is preferably made of tombac or copper and the cap 312 may be made of the same material or sheet steel. If it is made of sheet steel, its external surface is covered with a coating of tombac or copper, optionally applied by electroplating, in order to give the cap the same appearance as the rest of the projectile. The internal surface of the cap 312 may also be provided with a coating (not shown) of some material which improves adherence of the cap to the point 305 when it has been pushed into the cavity 304 after striking a target. This coating may be made of tin or of a plastics material. Lastly, the cap 312 may be made entirely of plastics material. Even in that case, it may be coated with tombac or copper on the outside to adapt its appearance to the remainder of the projectile.

Figure 32:
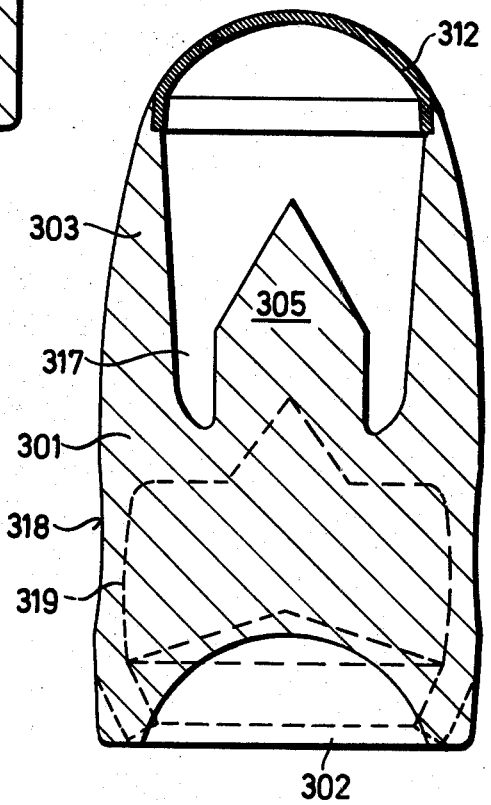

The example illustrated in FIG. 32 differs from that of FIG. 31 mainly in that a cylindrical gap 317 is provided between the cylindrical wall 301 and point 305 so that the cap 312 can be pushed further over the point 305 and can therefore be fixed more firmly on the point 305. This gap allows the wall 303 to yield inwards slightly when the projectile enters the barrel of the weapon.

To facilitate entry of the projectile body 301 into the rifling of the barrel and in particular to reduce the friction of the projectile in the barrel, the body 301 of the projectile is provided with a shallow circumferential groove 318 on its external surface, as shown in FIG. 32. In this particular example, the base of the groove has the form of a circular arc in section but other forms of grooves 318 may equally well be provided or a plurality of narrow grooves can be used to the same effect. Lastly, the groove 318 may also be designed to receive the upper end of the cartridge case (not shown) so that it fulfils a double purpose.

In FIG. 32 it is indicated how the projectile body 301 may also be constructed rather like a shell by making it hollow and inserting in it an insert 319 of a softer material such as lead. This lead insert 319 allows the wall of the projectile body 301 to move inwards slightly when the projectile is driven into the barrel of a weapon, so that in this case the groove 318 can be completely dispensed with. The lead insert 319 is placed in the projectile in such a manner that it does not come into direct contact with a target even on impact and therefore also leaves no trace of lead in the target.

Figure 33:
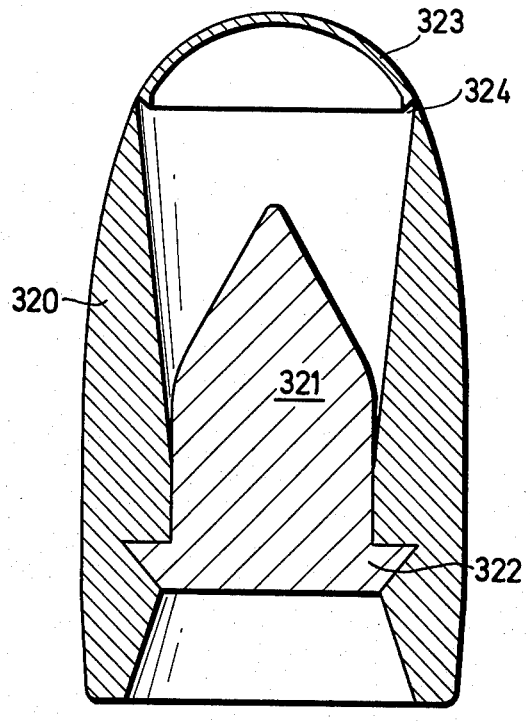

FIG. 33 shows a projectile comprising a shell 320 containing a point formed as an insert 321. This point has a circumferential shoulder 322 at its lower end, which is forced into the shell when the shell takes up its final position after assembly as shown in FIG. 33. To insert the point 321, the shell 320 is initially shaped conically so that the point can be pushed into it from behind. This conically formed shell 320 is then pressed into the cylindrical form shown in FIG. 33 so that the sharp edged shoulder 322 is driven into the material of the shell 320.

The shell is thin at its front end to form a cap 323 which is an integral part of the shell. A preset fracture line 324 in the form of a thinning out of material ensures that when the cap 323 hits a target, it is pushed inwards and over the point 321. The function of this projectile is similar to that of FIGS. 1 and 2.

The point forming the insert 321 is made of a hard material such, for example, as steel, and the shell 320 with cap 323 is made of tombac, for example.

Due to the particular form of the point with right angled shoulder and/or upright rim, the projectiles according to the invention deflect the material struck by them in a direction substantially perpendicular to the line of firing, that is to say all the material in front of the point is pushed or pressed sideways, including parts of the projectile situated in front of the point or the pain inducing substance originally provided there. As a result, the shot produces either a powerful stopping effect or a powerful shock effect, depending on the energy of impact which in turn depends on the selected initial velocity, and it also has a powerful penetrating effect, for example if the projectile strikes against a material such as sheet metal. The projectile changes its shape in the required manner on hitting the target and it produces fragments only when used as ammunition for hunting weapons. It does not wobble in its target. Since it is made of hard material, a clean exit from objects made of a hard material such as sheet metal, for example, is ensured.

The ammunition according to the invention used for shooting game is not deformed by foliage, branches, crop or similar obstacles in its line of firing and is therefore also not deflected by them. Moreover, "dosed" disintegration of the attachment in front of the projectile body proper is absolutely ensured and predetermined so that large fragments with a broad surface effect are produced and yet exit of the projectile from the body of the animal is ensured.

The ammunition according to the invention achieves optimum results with simple means. All the described individual features of the various embodiments of the ammunition can be used in any combination with each other.

The tip located on the front of the projectile does not necessarily have to have a pointed end to achieve the desired effect. A flattened, rounded or otherwise curved end is also possible. As a result, the mass of the projectile can, under certain circumstances, even be increased, although the expansion of the projectile may be retarded. A flattened, rounded or curved tip is also capable of supporting a cap, when this is provided on the projectile.

I claim:

1. A cartridge for hand firearms and shoulder arms, comprising a cartridge case containing powder and a fuse, and a projectile inserted in said case, said projectile comprising a substantially cylindrical main body of hard material such as iron, tombac or copper, said body including a forwardly projecting annular rim portion which defines a central cavity and which mushrooms out upon the projectile striking the target, the leading end of said rim portion being constructed to form a shoulder, a convex cap at the front of said projectile and closing said cavity, said cap engaging and being supported by said shoulder, and a central projecting, generally pointed tip integral with said body and extending into said cavity, said cap remaining essentially intact and being pushed into said cavity so that said cap is fixed to said tip upon the projectile striking a target.

2. A cartridge according to claim 1, wherein said projected rim portion projects forwardly beyond said tip.

3. A cartridge according to claim 1, wherein the inner surface of said forwardly projecting rim portion is downwardly and inwardly tapered whereby said rim portion increases in thickness as it approaches the base of said tip.

4. A cartridge according to claim 3, wherein the base of said tip bears against the inwardly tapered surface of said rim portion.

5. A cartridge according to claim 4, wherein the plane of separation between the base of said tip and the internal wall of said rim portion ends in an inwardly curved hook.

6. A cartridge according to claim 1 wherein a coating is provided on the internal surface of said cap to promote adherence to said tip.

7. A cartridge according to claim 6, wherein the width of the bearing surface of said step of said shoulder is less than the thickness of said rim of said projectile body at the level of said step.

8. A cartridge according to claim 1, wherein said shoulder is formed by a step extending at approximately a right angle to the longitudinal axis of the projectile and a side wall which tapers conically towards the outside, the angle formed by said step and said side wall thereby being acute.

9. A cartridge according to claim 1, wherein said cap has an aperture therein designed to serve as a vent.

10. A cartridge according to claim 1, wherein a hemispherical recess is provided at the rear end of said projectile body.

11. A cartridge according to claim 1, wherein a conical recess is provided at the rear end of said projectile body.

12. A cartridge according to claim 1 wherein an annular space is provided between the bottom of said rim portion of said body and the base of said tip thereby enabling said cap to be pushed further over said top when the projectile strikes a target.

13. A cartridge according to claim 1 wherein said main body is provided with a shallow circumferential groove on its external surface.

14. A cartridge according to claim 1 wherein the lower portion of said main body is hollow, and insert means of a softer material such as lead disposed in said hollow portion of said body.

* * * * *